United States Patent [19]

Maeda

[11] 4,131,180

[45] Dec. 26, 1978

[54] SPEAKER SYSTEM

[75] Inventor: Yoichi Maeda, Tokyo, Japan

[73] Assignee: Trio Kabushiki Kaisha, Tokyo, Japan

[21] Appl. No.: 778,998

[22] Filed: Mar. 18, 1977

[30] Foreign Application Priority Data

Apr. 12, 1976 [JP] Japan ..... 51-45258[U]

[51] Int. Cl.[2] ..... G10K 13/00; H04R 7/00

[52] U.S. Cl. ..... 181/163; 181/166; 181/156

[58] Field of Search ..... 181/163, 144, 147, 148, 181/156, 166, 199, 157, 173; 179/115.5 R, 115 R, 180, 181 R

[56] References Cited

U.S. PATENT DOCUMENTS

| | | | |
|---|---|---|---|
| 1,930,186 | 10/1933 | Swallow | 181/163 |
| 1,988,250 | 1/1935 | Olson | 181/147 |
| 2,013,953 | 9/1935 | Grissinger | 181/163 |
| 2,713,396 | 7/1955 | Tavares | 181/199 |
| 2,853,145 | 9/1958 | Martin | 181/163 |
| 3,074,504 | 1/1963 | Trautman | 181/166 |
| 3,780,824 | 12/1973 | Prince | 181/144 |

*Primary Examiner*—Stephen J. Tomsky
*Attorney, Agent, or Firm*—Gerald J. Ferguson, Jr.; Joseph J. Baker

[57] ABSTRACT

A speaker system comprising a speaker unit, a drone cone driven by the speaker unit; and a removable weight loaded on the front of the drone cone which can be exchanged from the front of the drone cone.

2 Claims, 6 Drawing Figures

SPEAKER SYSTEM

BACKGROUND OF THE INVENTION

1. Field of the Invention:

This invention relates to a speaker system whose characteristics are readily changeable according to the conditions of the listening room.

2. Discussion of the Prior Art:

It is known, generally, even when identical speaker systems are used, the frequency response, etc. of the speaker systems vary depending upon the conditions of the listening room or the location of the speaker system installation. Specifically speaking, when the speaker system is placed directly on the floor with its back and a side against the walls, the bass increases due to the baffling effect of the walls, etc. as shown by characteristic *a* in FIG. 1. And, when it is placed away from the walls and floor, the bass decreases approaching the characteristic of an anechoic room, as shown in characteristic c in FIG. 1. Therefore, with conventional speaker systems, there has been a shortcoming in that good frequency response such as characteristic *b* could not be obtained when the installation site was poor.

SUMMARY OF THE INVENTION

Thus, in this invention, the objective was to provide a speaker system with which good sound reproduction could be obtained by eliminating the above-mentioned shortcoming and changing the speaker characteristics according to the installation site.

DETAILED DESCRIPTION OF THE PREFERRED EMBODIMENT OF THE INVENTION

Figure 1:
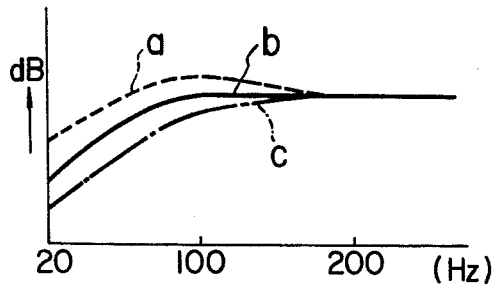
FIG. 1 is a frequency response curve for a speaker system affected by the conditions of the installation site.

The invention is explained below based on an actual embodiment shown by the figures of the drawing.

Figure 2:
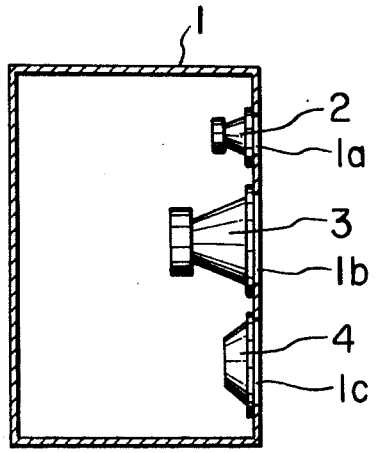
FIG. 2 is a sectional side view sketch of a speaker system for explaining this invention.
Figure 3:
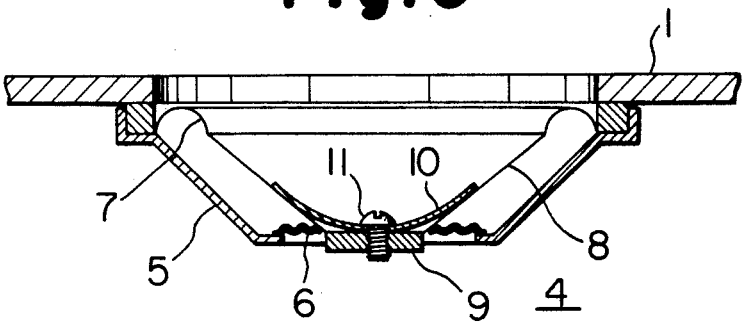
FIG. 3 is a sectional side view showing a drone cone in accordance with this invention.

FIG. 2 is a cross sectional side view of a speaker system according to this invention. An enclosure 1 is provided and speaker units 2 and 3 are mounted at front openings 1*a* and 1*b* respectively. At another opening 1*c*, only a vibrating diaphragm — that is, a drone cone 4 is mounted. Enclosure 1 is sealed and as is known, drone cone 4, without a drive (voice coil, etc.), is driven by speaker unit 3. Drone cone 4 is constructed as shown in FIG. 3, which shows a cone 8 hung from a frame 5 by a damper 6 and edge 7. At the center of cone 8, a weight 9 providing an appropriate load is installed. There is a tapped hole in the center of a weight 9 for screwing in a screw 11 to thereby frictionally hold these two elements together. On the front of weight 9, that is on the side where sound is radiated by cone 8, a tuning weight (mass) 10 is fixed with screw 11. By unscrewing and removing screw 11, tuning weight 10 becomes freely exchangeable. Thus, the load on drone cone 4 can be changed.

Figure 4:
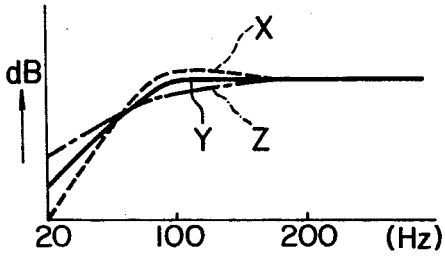
FIG. 4 is a frequency response curve illustrating the effect of different drone cone weights.

Changes in the frequency response of the speaker system were observed by varying the load (sum of weight 9 and tuning weight 10) on a drone cone 4 constructed as above. As shown in FIG. 4, if the proper weight is designated as Y, then, when the weight is light, bass increases at about 100 Hz as in characteristic X, and when the weight is heavy, the area around 100 Hz decreases as in characteristic Z.

Consequently, by using a drone cone 4, as shown in FIG. 4, in a speaker system, and applying its characteristics, the frequency response that is affected by the surrounding conditions as shown in FIG. 1 can be compensated. In other words, when the bass output frequency response increases as indicated by characteristic *a* of FIG. 1 due to the installation site of the speaker system, a normal output frequency response can be obtained by removing screw 11 of drone cone 4 from the front — that is, the sound radiating side and exchanging tuning weight 10 for a heavier one so that the area around 100 Hz decreases as indicated by characteristic Z. Or, when the output frequency response corresponds to characteristic *c* of FIG. 1 due to the installation conditions of the speaker system, tuning weight 10 of drone cone 4 is changed to a lighter one in a manner similar to that described above and the output frequency response is compensated by adjusting the speaker system as indicated by characteristic X of FIG. 4.

Figure 5:
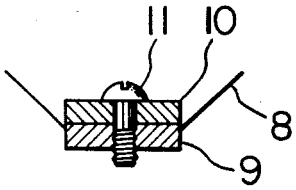
FIGS. 5 and 6 are sectional side views showing other embodiments of this invention.
Figure 6:
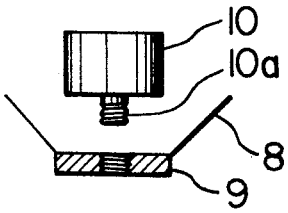

A cross-sectional U-shaped tuning weight 10 is shown in FIG. 3. However, if necessary, it may be a flat plate as shown in FIG. 5. Or, as shown in FIG. 6, a threaded part 10*a* may be incorporated on tuning weight 10 and weight 9 stabilized with this threaded part.

As described above, the effective aspects of this invention are: a speaker system with a drone cone is so built that a weight (mass) loaded on the drone cone can be exchanged from the front — that is, from the sound-radiating side of the drone cone. Thus, when the frequency response is changed, the drone cone need not be taken out of the enclosure for adjustment. Also, when the frequency response of the speaker system is affected by the installation site, it can be easily compensated to obtain a good frequency response by changing the weight according to the condition at the installation site.

What is claimed is:

1. A speaker system comprising an enclosure, a loudspeaker opening in said enclosure, a loudspeaker mounted over said loudspeaker opening, a further opening in said enclosure, a drone cone mounted over said further opening and driven by said loudspeaker, a first weight attached to the drone cone, a removable tuning weight, and fastening means removably fastening said removable tuning weight to the front side of said first weight and removable from the front side, said fastening means being frictionally attached to said first weight.

2. A speaker system as in claim 1 where said fastening means is threaded to said first weight.

* * * * *